US005539949A

United States Patent [19]

Stanton

[11] Patent Number: 5,539,949

[45] Date of Patent: Jul. 30, 1996

[54] HINGED SQUEEGEE

[76] Inventor: John L. Stanton, 3600 Baywood Dr., Nacogdoches, Tex. 75961

[21] Appl. No.: 279,957

[22] Filed: Jul. 25, 1994

[51] Int. Cl.[6] ..... A47L 1/06; A47L 13/11; A47L 13/12

[52] U.S. Cl. ..... 15/121; 15/105; 15/117; 15/144.1; 15/244.2; 15/245

[58] Field of Search ..... 15/105, 117, 121, 15/144.1, 220.1, 244.2, 245, 106, 107, 110, 111, 113–115, 118

[56] References Cited

U.S. PATENT DOCUMENTS

| | | | |
|---|---|---|---|
| 109,946 | 12/1870 | Rockwell et al. | 15/117 |
| 614,696 | 11/1898 | Brown | 15/220.1 |
| 629,835 | 8/1899 | Wertsbaugher | 15/121 |
| 731,338 | 6/1903 | Cattelle | 15/245 |
| 869,942 | 10/1907 | Hill | 15/220.1 |
| 1,335,451 | 3/1920 | Moore | 15/245 |
| 1,376,195 | 4/1921 | Fernandez | 15/118 |
| 1,378,243 | 5/1921 | Kracke | 15/220.1 |
| 1,827,121 | 10/1931 | Trane | 15/245 |
| 1,838,481 | 12/1931 | Guoka | 15/114 |
| 1,964,134 | 6/1934 | Oberti | 15/245 |
| 2,193,571 | 3/1940 | Siemund | 15/245 |
| 2,278,208 | 3/1942 | Minnis | 15/245 |
| 2,534,086 | 12/1950 | Vosbikian et al. | 15/115 |
| 2,980,457 | 4/1961 | Page . | |
| 3,079,624 | 3/1963 | Neal | 15/245 |
| 3,085,270 | 4/1963 | Vosbikian et al. | 15/114 |
| 3,395,415 | 8/1968 | Leland | 15/121 |
| 3,537,123 | 11/1970 | Leland | 15/121 |
| 3,568,237 | 3/1971 | Rhodes | 15/144.1 |
| 3,766,591 | 10/1973 | Soito | 15/245 |
| 3,909,870 | 10/1975 | Leland | 15/244.2 |
| 4,236,270 | 12/1980 | Mavis | 15/245 |
| 4,312,093 | 1/1982 | Raab | 15/121 |
| 4,455,705 | 6/1984 | Graham | 15/121 |
| 4,893,370 | 1/1990 | Klotz | 15/121 |
| 5,175,902 | 1/1993 | Samuelsson | 15/245 |
| 5,255,405 | 10/1993 | Samuelsson et al. | 15/245 |
| 5,333,347 | 8/1994 | Stranders | 15/220.1 |
| 5,347,676 | 9/1994 | Saitoh | 15/245 |

FOREIGN PATENT DOCUMENTS

| | | | |
|---|---|---|---|
| 192080 | 9/1957 | Austria | 15/114 |
| 567081 | 2/1924 | France | 15/245 |
| 449525 | 9/1927 | Germany | 15/115 |
| 9440 | of 1908 | United Kingdom | 15/245 |
| 1107458 | 3/1968 | United Kingdom | 15/220.1 |
| 89-10721 | 11/1989 | WIPO | 15/144.1 |

*Primary Examiner*—Mark Spisich
*Attorney, Agent, or Firm*—Fish & Richardson P.C.

[57] ABSTRACT

A squeegee-type cleaning implement has a wiping assembly including a plurality of spaced implements for wiping moisture from the surface to be cleaned, and a handle pivotally connected to the wiping assembly by a hinge. The hinged attachment of the wiping assembly to the handle allows the squeegee to clean the surface (e.g., a window pane) either from top to bottom or from side to side using continuous strokes. The wiping assembly is constructed so that a first one of the implements (which are, e.g., straight blades) precedes a second one of the implements when the implements are wiped over the surface. The first, leading blade is oriented substantially perpendicularly to the surface to maintain the second, trailing blade in contact with the surface at an angle of approximately 45 degrees over the range of travel of the trailing blade across the surface. The blades are spaced by approximately the blade height. As a result, the leading blade helps stabilize the trailing blade on the surface, thereby assuring that the surface will be thoroughly cleaned of water or other liquid in a single pass of the squeegee from top to bottom or side to side.

19 Claims, 4 Drawing Sheets

HINGED SQUEEGEE

BACKGROUND OF THE INVENTION

This invention relates to implements for cleaning windows and other surfaces.

Cleaning implements for windows are popularly known as "squeegees." A typical squeegee includes a blade made from a soft material (such as rubber or a sponge) mounted to an elongated handle. In use, the user grasps the handle, and positions the blade against the surface of the window (which has been moistened with water or a cleaning solution), and pulls or pushes the handle to move the blade either vertically or horizontally across the surface.

SUMMARY OF THE INVENTION

In one general aspect, this invention provides a squeegee-type cleaning tool in which a device for wiping a surface is pivotally connected to a handle by a hinge that allows the handle to freely pivot between opposite angular positions with respect to the wiping device as the device is wiped across the surface.

The hinged attachment of the wiping device to the handle allows the squeegee to clean large, flat surfaces (e.g., a window or a floor) either from top to bottom or from side to side using continuous pushing or pulling strokes. There is no need for the user to reverse the wiping action or stoop or otherwise change his or her position to reach, e.g., the lowermost edge of the surface. In fact, the user can remain in an erect or standing position even when using the squeegee to clean large window surfaces that extend from above the user's head to floor level.

Preferred embodiments include the following features.

The hinge includes a first component rigidly attached to the wiping device, a second component rigidly attached to the handle, and a pin linking the first and second components together for relative rotation. The components preferably include three tubular elements through which the pin passes—a center element and a pair of outer elements. In one embodiment, the outer elements are secured to the wiping device, and the center element is secured to the handle. In another embodiment, the reverse is true.

The wiping device includes a plurality of spaced implements for wiping the surface. The implements are preferably a pair of squeegee blades, but a wide variety of other implements (such as sponges and rollers) can also be used.

The wiping device is constructed so that a first one of the blades precedes a second one of the blades during wiping. The first, leading blade is oriented to maintain the second, trailing blade in contact with the surface over a selected range of travel of the second blade across the surface. Preferably, the first blade is oriented perpendicularly to the surface, while the second blade is oriented at an angle of approximately 45 degrees to the surface.

The blades are attached together by one or more connectors which maintain a selected spacing therebetween. Preferably, the selected spacing equals the blade height.

The hinge pivotally mounts the handle to the trailing implement, which includes a holder for supporting the blade. The hinge pivotally mounts the handle to a trailing side of the holder relative to the leading implement. Further, the hinge is mounted to the holder so that the hinge is spaced from the surface by at a distance equal to one-half of the blade height.

The handle may be self-contained or constructed for connection to a second handle (for example, an extension tube that allows the wiping assembly to reach high places).

The construction of the squeegee assures that the surface will be thoroughly cleaned of water or other liquid in a single pass from top to bottom or side to side. Specifically, the orientation of the first—i.e., the leading—implement enables it to act as an outrigger to stabilize the second, trailing implement on the surface. Moreover, the leading implement provides a pre-wipe of the surface to further increase the wiping efficiency of the squeegee. The placement of the hinge helps assure that the trailing implement is maintained at the proper angle to the surface and applies constant wiping pressure to the surface over the entire range of travel.

The squeegee of the invention (whether double-bladed or equipped with other wiping devices) is inexpensive to manufacture and simple in construction. The squeegee is strong and durable, yet compact and lightweight, and is easy to use. Further, the wiping implement construction effectively eliminates "chattering" displayed by conventional squeegees near the bottom of tall windows (or the sides of wide windows).

Other features and advantages of the invention will be apparent from the following detailed description, and from the claims.

DESCRIPTION OF PREFERRED EMBODIMENTS

Figure 2:
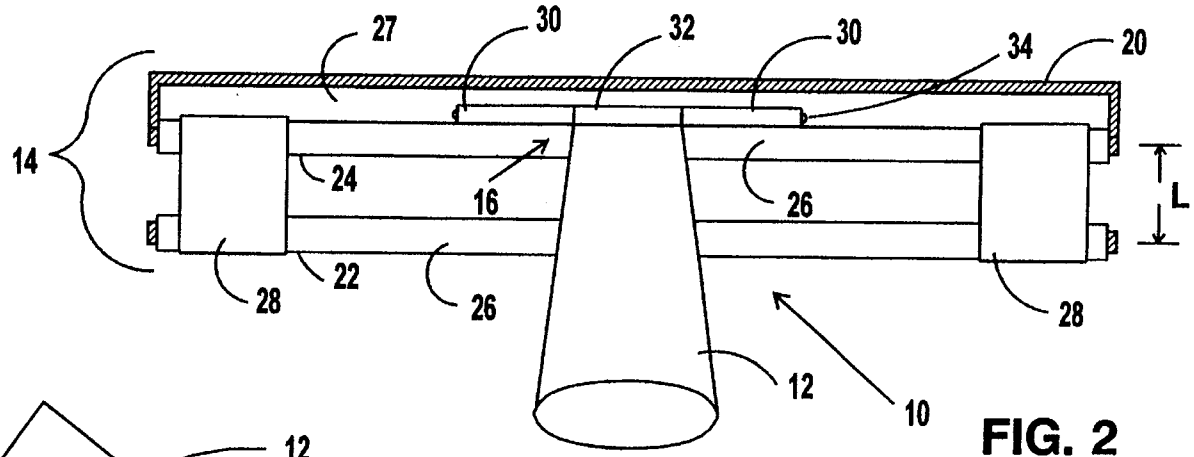
FIG. 2 is a top view of the squeegee of FIG. 1.
Figure 1:
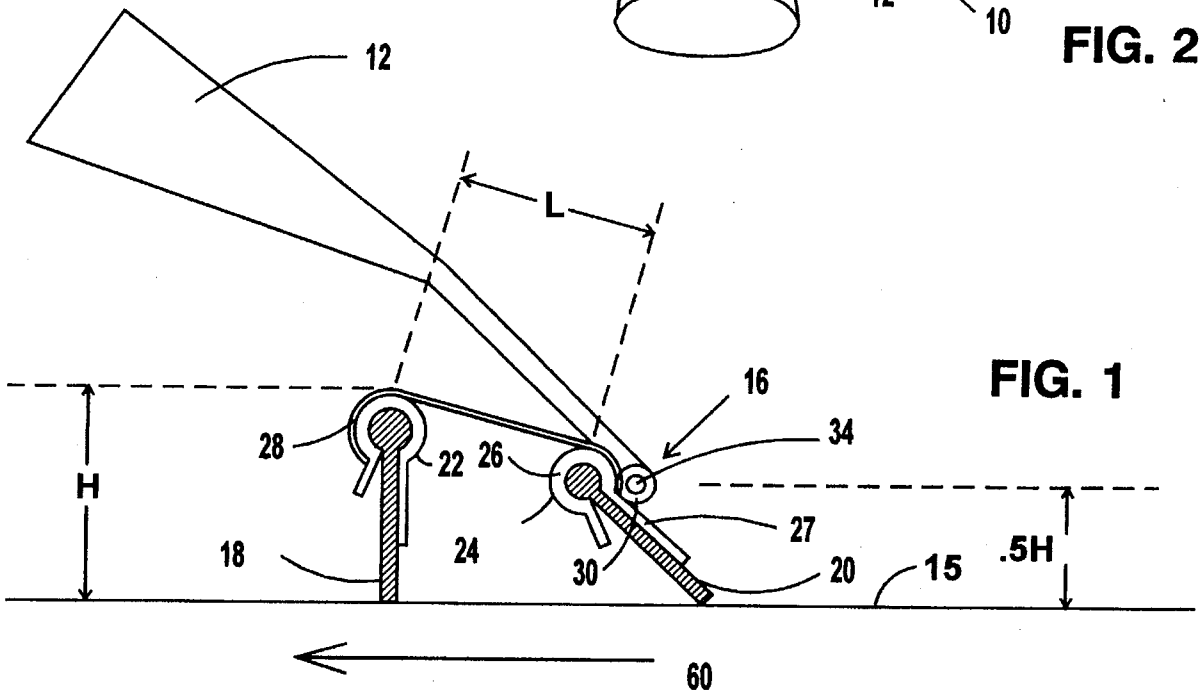
FIG. 1 is a side view of a hinged, double-bladed squeegee.
Figure 3:
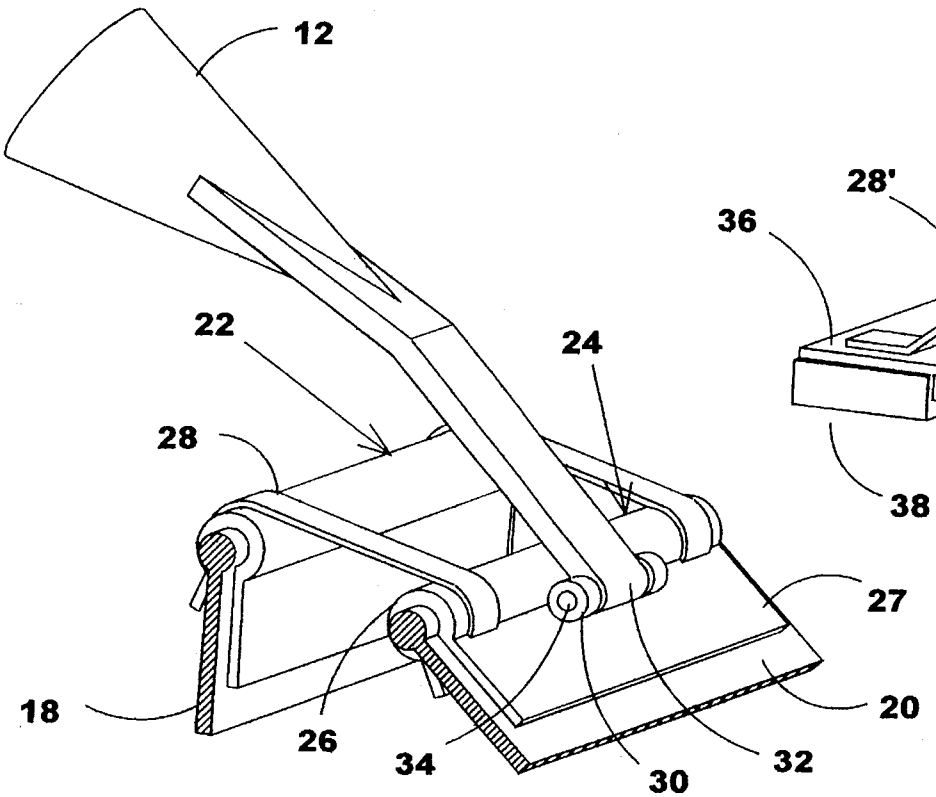
FIG. 3 is a perspective view of the squeegee of FIG. 1.

Referring to FIGS. 1–3, squeegee 10 includes an elongated handle 12 connected to a blade assembly 14 by a hinge 16 that allows handle 12 to freely pivot with respect to blade assembly 14 as blade assembly 14 is wiped across the surface 15 of a window. The pivotal attachment of handle 12 ensures that individual, straight wiper blades 18, 20 of blade assembly 14 remain in contact with window surface 15 over the full range of travel of squeegee 10 across the window (e.g., from the top edge to the bottom edge of the window or from one side edge of the window to the other side edge of the window).

Blades 18, 20 are made from rubber or other suitable soft material, and are supported parallel to each other within a pair of straight, rigid blade holders 22, 24, respectively. Blades 18, 20 perform the actual cleaning of the window, and protect the window surface being scratched or marred by holders 22, 24. During use, blade assembly 14 is moved in the direction of arrow 60 in FIG. 1 with blade 20 trailing blade 18.

As shown best by FIG. 1, each arm 22, 24 defines an elongated channel 26 and a pair of straight rigid fins, one of which (27) is longer than the other for purposes to be described. Holders 22, 24 are open at their ends to allow blades 18, 20 to be inserted into (and removed from) holders 22, 24 from the side. Each blade 18, 20 has an enlarged, rounded base that fits snugly within channel 26 to retain blades 18, 20 within holders 22, 24 as blade assembly 14 is wiped across surface 15.

A pair of connectors 28 secured to the ends of holders 22, 24 (FIGS. 2 and 3) rigidly secure holders 22, 24 together in parallel to each other. The lengths of connectors 28 is selected so that the distance (L) between the centers of channels 26 of holders 22, 24 is approximately equal to the height (H) of each blade 18, 20. As a result, the spacing between blades 18, 20 approximates the height of each blade 18, 20. Additional connectors 28 spaced along the lengths of holders 22, 24 may be used, if desired.

Hinge 16 includes a pair of outer tubular hinge elements 30 secured to trailing blade holder 24 at the junction of fin 27 and the rounded outer surface of channel 26. A center tubular hinge element 32 secured to handle 12 fits between outer hinge elements 30, and is pivotally linked thereto by a pin 34 received within hinge elements 30, 32.

The proper placement of hinge 16 is important to avoid blade assembly 14 flipping over or trailing blade 20 lifting off of surface 15 during use. Hinge 16 should not be attached too far forward (i.e., toward leading blade 18) or too high up on holder 24 of trailing blade 20. Nor should hinge 16 be placed too far back on arm 24 (i.e., away from leading blade 18), or else leading blade 18 may lift off of surface 15 (i.e., "chatter") during wiping. I have found that positioning hinge 16 on the trailing side of trailing blade holder 24 (FIG. 1) so that hinge 16 is spaced from surface 15 by approximately one half of the height H of leading blade 18 both avoids flipping of assembly 14 and retains blades 18, 20 on surface 15 as squeegee 10 is moved across the window.

Holder 22 is positioned so that blade 18 is oriented perpendicularly to the window surface 15. By contrast, holder 24 is arranged to incline blade 20 at an angle of 45° to surface 15. Blade 20 is tilted toward blade 18 so that the wiping edges of blades 18, 20 are spaced farther from each other than are the rounded bases of blades 18, 20.

Figure 4:
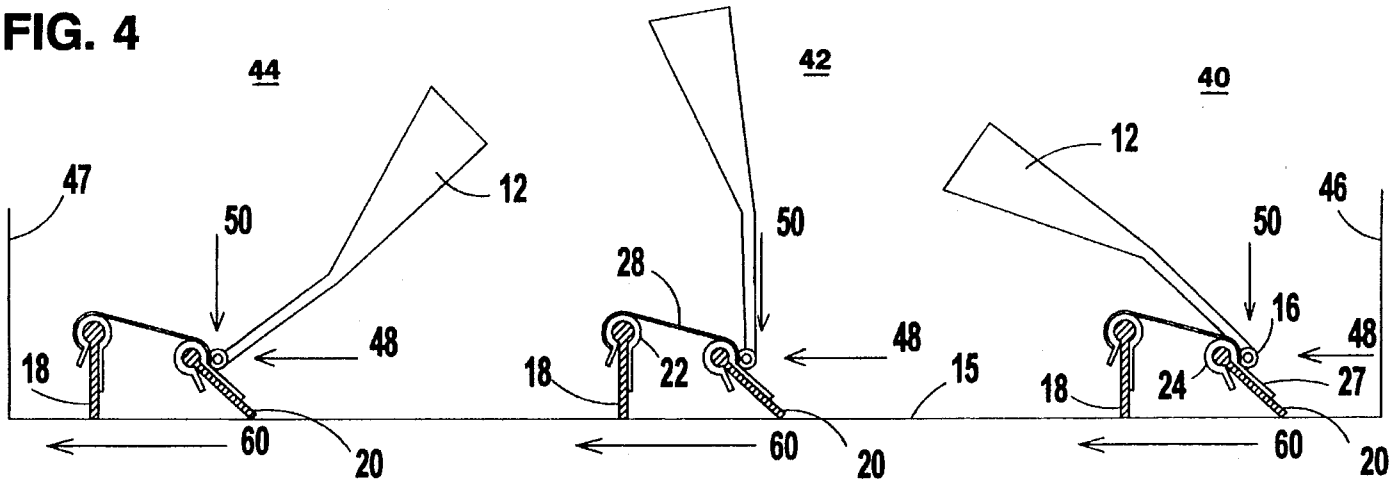
FIG. 4 illustrates the operation of the squeegee of FIG. 1.

Referring to FIG. 4, the operation of squeegee 10 is illustrated with squeegee 10 in three positions 40, 42, 44. Squeegee 10 is initially placed adjacent the upper edge 46 of window surface 15 (position 40). Note that in position 40, handle 12 is oriented nearly vertically, and blades 18, 20 are both set against surface 15.

The user initially pulls squeegee 10 downwardly in the direction shown by arrow 60. The user provides constant pressure in two directions—a downward force 48 to move blades 18, 20 across surface 15, and horizontal pressure along vector 50 to hold blades 18, 20 against surface 15. Handle 12 freely rotates through an arc as squeegee 10 progresses from being pulled, (position 40) through an intermediate stage near the center of the window (position 42), to being pushed (between position 42 and position 44). As a result, handle 12 pivots with respect to wiping assembly 14 between opposite angular positions (highly acute in position 40, nearly perpendicular in position 42, and highly obtuse in position 44) over the range of travel of squeegee 10 across surface 15.

Constant contact is maintained throughout the range of travel between trailing blade 20 and surface 15 sufficient to wipe the latter dry. Straight fin 27 of holder 24 provides backing support and maintains blade 20 at the desired 45 degree angle. Among the advantages provided by squeegee 10 are the pre-wipe of surface 15 that leading blade 18 performs, and the ability to clean surface 15 completely to lower edge 47 due to the perpendicular orientation of leading blade 18.

Thus, it will be appreciated that the user wipes squeegee 10 across surface 15 in a single, smooth stroke from upper surface 46 completely to lower edge 47. The user need not stop the wiping action as he or she nears lower edge 47, nor must the user stoop down or otherwise change his or her position to wipe surface 15 effectively all the way to lower edge 47.

Pressure applied by the user against handle 12 is conveyed through hinge 16 onto trailing blade 20 in the direction of travel, as represented by vector 48, and towards surface 15, as represented by vector 50. The sum force of these two vectors attempts to cause trailing blade 20 to tilt toward surface 15. If this were to occur, the optimal 45° angle defined by blade 20 with respect to surface 15 would be reduced, and the cleaning efficiency of blade 20 would be hampered. The rigid attachment of holders 22, 24 by connectors 28 and the perpendicular orientation of leading blade 18 with respect to surface 15 prevents trailing blade 20 from tilting in this manner.

Specifically, leading blade 18 serves as an "outrigger" which stabilizes trailing blade 20 against the undesired tilting. As a result, blades 18, 20 remain in contact with surface 15 over the full range of travel of squeegee 10 from upper edge 46 (position 40) to lower edge 47 (position 44).

The perpendicular orientation of leading blade 18 is important for optimizing the "outrigger" effect and wiping efficiency. If leading blade 18 were tilted rearwardly (i.e., swept back) toward trailing blade 20 to define an acute, rather than perpendicular, angle with surface 15 on the leading side of blade 18, contact between blade 18 and surface 15 would be moved closer to the region in which surface 15 is contacted by blade 20. The decreased spacing between the wiping edges of blades 18, 20 would reduce the outrigger effect of blade 18. In addition, leading blade 18 would not reach lower edge 47 of surface 15 and would leave an unwiped area near edge 47.

Conversely, tilting leading blade 18 in the opposite direction (so that it defines an acute angle with respect to surface 15 on the trailing side of blade 18) would increase its outrigger effect (due to the increased spacing between the wiping edges of blades 18, 20), but because a blade wipes efficiently only when oriented perpendicularly or swept back with respect to surface 15, tilting blade 18 forwardly would hamper the ability of blade 18 to wipe surface 15. For the same reason, a forwardly-tilted blade 18 would be prone to "chattering" against surface 15.

Other embodiments are within the scope of the claims.

For example, while the operation of squeegee 10 has been described with respect to a vertical wiping stroke, squeegee 10 may also be wiped horizontally across surface 15. The pivotal mounting of handle 12 and the configuration of blade assembly 14 maintain contact between blades 18, 20 and surface 15 over the entire range of travel from one side edge of surface 15 to the other.

Figure 5:
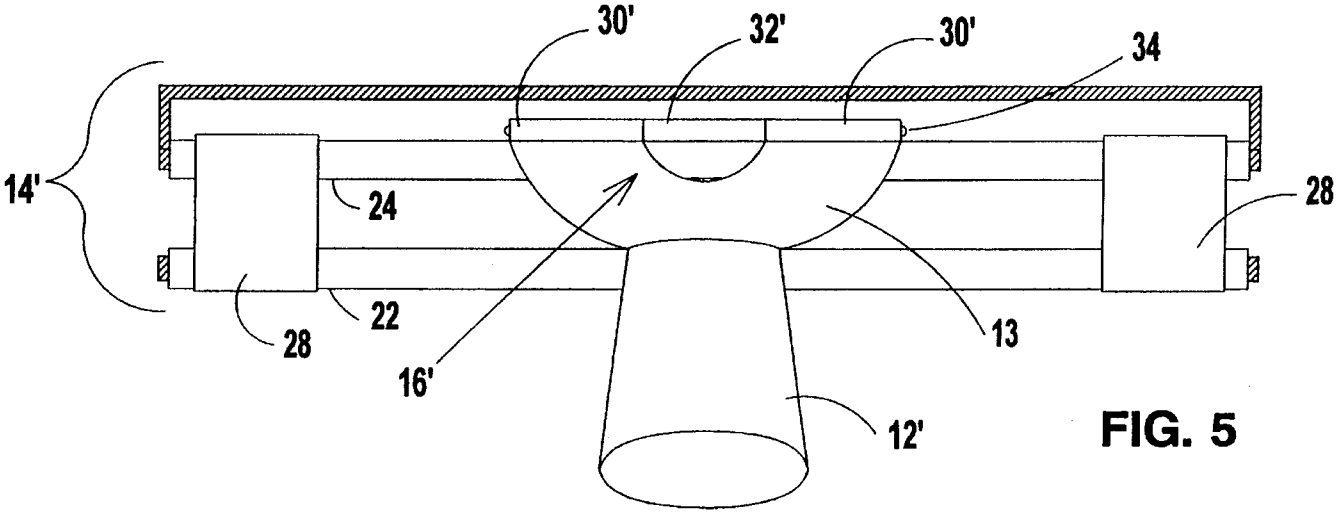
FIG. 5 is a top view of an alternative embodiment of the squeegee.

FIG. 5 shows an alternative hinge 16' for use in a squeegee having a relatively long blade assembly 14'. Hinge 16' is longer than hinge 16 to afford the user added control over the larger blade assembly 14'. Outer hinge elements 30' are spaced relatively widely and are secured to a pair of legs 13 at the end of handle 12' (which is "Y" shaped). A long center hinge element 32' mounted on holder 24 (in the position described above with respect to hinge 16) is linked to outer elements 30' by a pin 34. The increased length of hinge 16' helps prevent squeegee 10 from turning or rotating if one side or other of blade assembly 14' "catches" on a dry or rough area of surface 15.

Other types of hinges can be substituted for the pinned hinges described herein.

Other devices can be used to provide the outrigger effect for trailing blade 20.

Figure 7:
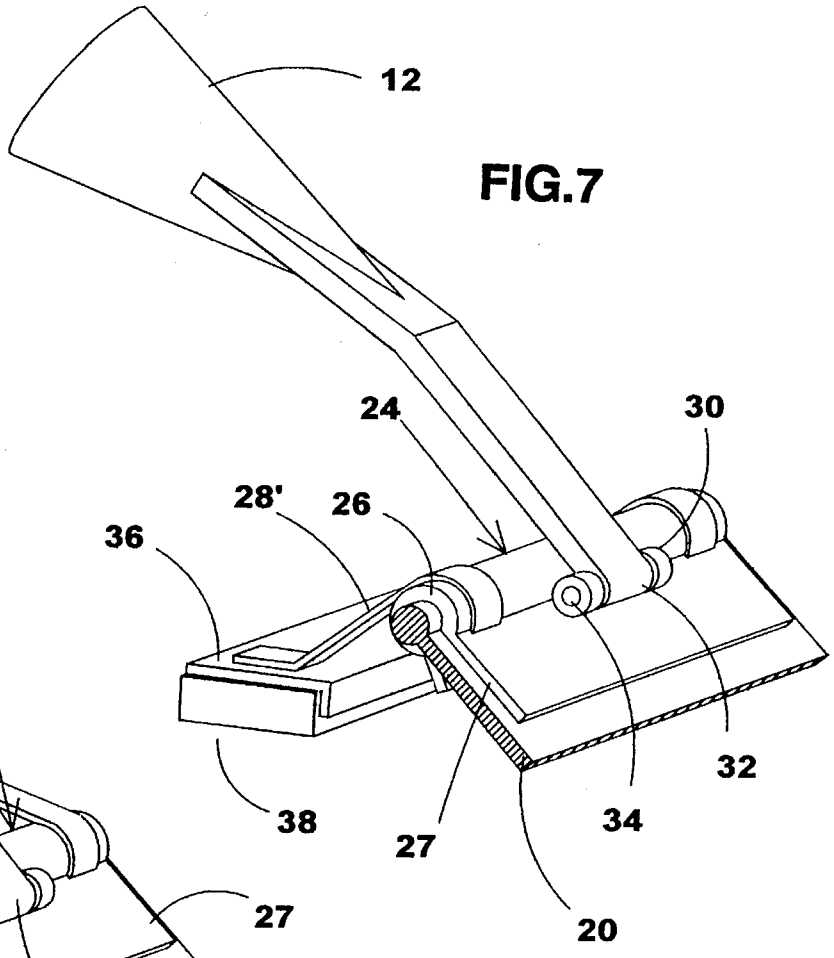
FIGS. 6 and 7 are respective side and perspective views of another embodiment of the hinged squeegee.
Figure 6:
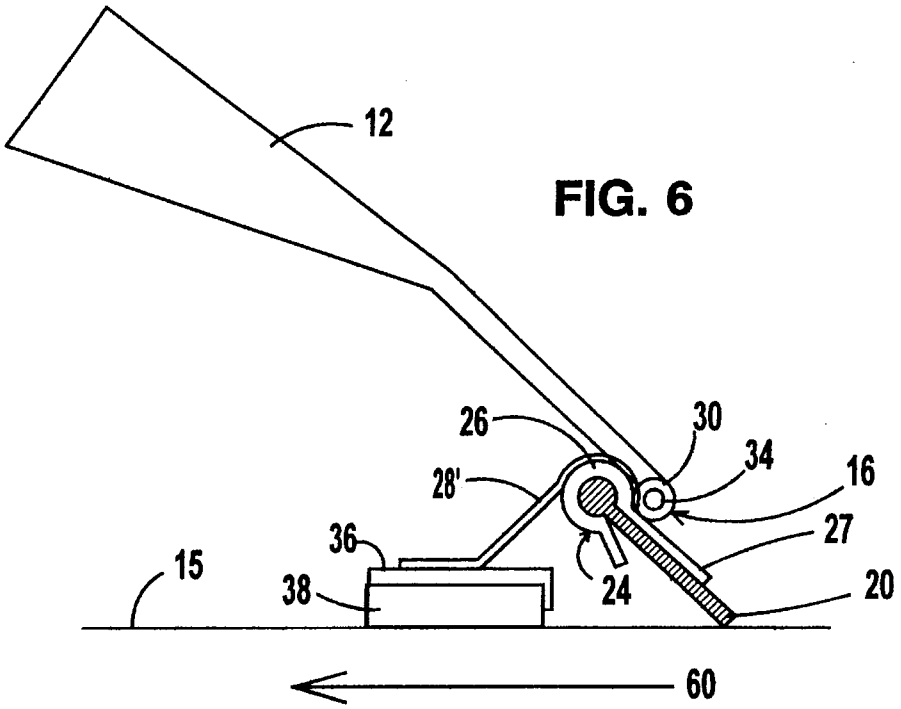

For example, referring to FIGS. 6 and 7, leading blade 18 may be replaced with a flat, elongated sponge 38. An elongated, L-shaped holder 36 supports sponge 38, and is linked to trailing blade holder 24 by a series of connectors 28'. Connectors 28' are angled as shown to allow sponge 38 to lie flat on surface 15 with blade 20 at a 45 degree angle with respect to surface 15.

Figure 8:
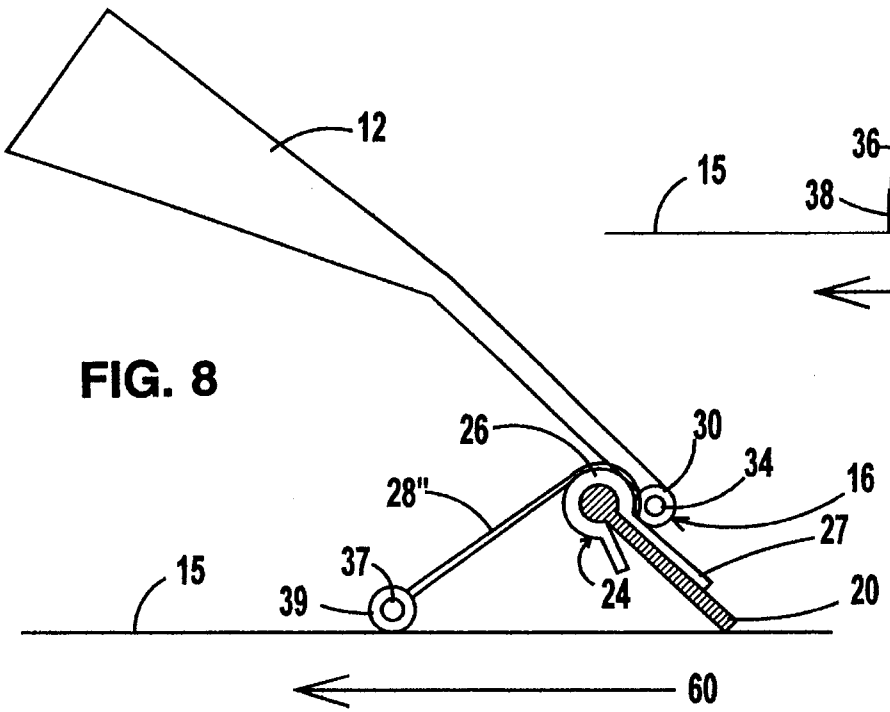
FIG. 8 is a side view of yet another embodiment of the hinged squeegee.

Referring to FIG. 8, in yet another approach, one or more rollers 39 are used in place of leading blade 18. Either a single roller 39 that approximates the length of trailing blade 20 or a series of smaller rollers 39 may be used. In both cases, the roller (or rollers) 39 rotates about a rigid hinge 37 that is linked to trailing blade holder 24 by one or more connectors 28".

Other alternatives for leading blade 18 include a metal or plastic runner or a brush. The advantages, however, of using a squeegee blade 18 to provide the outrigger effect include its ability to pre-wipe surface 15 without marring or damaging it.

A relatively short handle 12 has been shown for ease of illustration. It will be appreciated that handle 12 can have any desired length. Indeed, handle 12 can simply be a short tube or the like for receiving another handle of any desired length.

Squeegee 10 may be used for cleaning other surfaces, such as walls and floors.

What is claimed is:

1. Apparatus comprising a device including a base and a plurality of implements each of which is attached to said base and has a free end, said plurality of implements being arranged so that the free ends thereof are spaced from each other and disposed in a wiping plane, with a first one of said implements and a second one of said implements being oriented differently with respect to said wiping plane so that said second implement is positioned on a trailing side of said first implement as said device is wiped in a selected direction over a surface disposed in said wiping plane, a handle, and a hinge mounted on said base and pivotally connecting said handle to said base so that said handle can freely pivot between a leading position and a trailing position with respect to said implements as said free ends of said first and second implements are wiped across said surface in said selected direction, said hinge being positioned on a trailing side of said second implement relative to said first implement when said device is wiped in said selected direction.

2. The apparatus of claim 1 wherein said hinge includes a first component rigidly attached to said base, a second component rigidly attached to said handle, and a pin linking said first component and said second component together for relative rotation.

3. The apparatus of claim 2 wherein said first component includes a pair of spaced tubular elements secured to said base, said second component includes a tubular element secured to said handle and disposed between said pair of tubular elements, and said pin is disposed through all of said tubular elements.

4. The apparatus of claim 2 wherein said first component includes a tubular element secured to said base said second component includes a pair of spaced tubular elements secured to said handle and disposed on opposite sides of said tubular element of said implement, and said pin is disposed through all of said tubular elements.

5. The apparatus of claim 1 wherein said first implement is configured to maintain said second implement in contact with said surface over a selected range of travel of said second implement across the surface in said selected direction.

6. The apparatus of claim 5 wherein said first implement and said second implement each includes a straight blade, said first implement being oriented to be substantially perpendicular to the surface.

7. The apparatus of claim 6 wherein said second implement is oriented at an angle of approximately 45 degrees to the wiping plane.

8. The apparatus of claim 5 wherein said second implement includes a straight blade and said first implement includes another member for wiping the surface.

9. The apparatus of claim 8 wherein said another member includes at least one sponge the free end of which includes a surface disposed in said wiping plane.

10. The apparatus of claim 8 wherein said another member includes at least one roller.

11. The apparatus of claim 1 wherein said base comprises at least one connector, a first end of said first implement and a first end of said second implement being attached together at a selected spacing by said connector.

12. The apparatus of claim 11 wherein one of said first and second implements includes a straight blade, said selected spacing being equal to a height of said blade.

13. The apparatus of claim 1 wherein said base includes a holder for supporting said second implement, said hinge being mounted on a trailing side of said holder relative to said first implement when said device is wiped in said selected direction.

14. The apparatus of claim 1 wherein said handle is constructed for connection to a second handle.

15. Apparatus comprising a device including a base and a plurality of implements each of which is attached to said base and has a free end, said plurality of implements being arranged so that the free ends thereof are spaced from each other and disposed in a wiping plane, with a first one of said implements and a second one of said implements being oriented differently with respect to said wiping plane so that said second implement is positioned on a trailing side of said first implement as said device is wiped in a selected direction over a surface disposed in said wiping plane, said base including a holder for supporting said second implement, a handle, and a hinge mounted on said base and pivotally connecting said handle to said base so that said handle can freely pivot between a leading position and a trailing position with respect to said implements as said free ends of said first and second implements are wiped across said surface, said hinge being mounted on a trailing side of said holder relative to said first implement when said device is wiped in said selected direction, one of said first and second implements including a straight blade, said hinge being mounted to said holder so that said hinge is spaced from said wiping plane by a distance equal to one-half of a height of said blade.

16. Apparatus comprising a base, a plurality of implements each of which is attached to said base and has a free end, said implements being arranged so that the free ends thereof are spaced from each other and disposed in a wiping plane, with a first one of said implements and a second one of said implements being oriented differently with respect to said plane so that said second implement is positioned on a trailing side of said first implement as said apparatus is wiped in a selected direction over a surface disposed in said wiping plane, said first and second implements being configured to maintain said free end of said second implement in contact with the surface over a selected range of travel of said second implement across the surface in said selected direction, a handle, and a hinge mounted on said base and pivotally connecting said handle to said base so that said handle can freely pivot between a leading position and a trailing position with respect to said second implement as said free ends are wiped across the surface over the selected range of travel in said selected direction, said hinge being positioned on a trailing side of said second implement relative to said first implement when said apparatus is wiped in said selected direction.

17. Apparatus comprising a plurality of implements each of which includes a first end secured to a base and a free end, the free ends of said implements being spaced from each other and disposed in a wiping plane, said plurality of implements being arranged so that a first one of said plurality of implements precedes a second one of said plurality of implements when said free ends are wiped in a selected direction across a surface in the wiping plane, a handle, and a hinge mounted on said base pivotally connecting said handle to said base so that said handle can pivot between a leading position and a trailing position with respect to said implements as said free ends of said implements are wiped across said surface in said selected direction, said hinge being disposed on a trailing side of said first end of said second implement relative to said first implement when said apparatus is wiped in said selected direction.

18. The apparatus of claim 17 wherein said plurality of implements are arranged so that said first implement and said second implement are oriented differently with respect to said wiping plane.

19. The apparatus of claim 18 wherein said second implement is oriented at an angle of approximately 45 degrees to said wiping plane.

* * * * *